US011613907B2

(12) United States Patent
Fakhari

(10) Patent No.: US 11,613,907 B2
(45) Date of Patent: Mar. 28, 2023

(54) TEMPORARY FENCE ASSEMBLY

(71) Applicant: F & F Composite Group, Inc., Keller, TX (US)

(72) Inventor: M. John Fakhari, Fort Worth, TX (US)

(73) Assignee: F & F Composite Group, Inc., Keller, TX (US)

( * ) Notice: Subject to any disclaimer, the term of this patent is extended or adjusted under 35 U.S.C. 154(b) by 57 days.

(21) Appl. No.: 17/451,595

(22) Filed: Oct. 20, 2021

(65) Prior Publication Data

US 2022/0042345 A1 Feb. 10, 2022

Related U.S. Application Data

(63) Continuation-in-part of application No. 16/261,124, filed on Jan. 29, 2019, now abandoned.

(60) Provisional application No. 62/623,135, filed on Jan. 29, 2018.

(51) Int. Cl.

| | |
|---|---|
| ***E04H 17/18*** | (2006.01) |
| ***E04H 17/16*** | (2006.01) |
| ***E04H 17/00*** | (2006.01) |

(52) U.S. Cl.

CPC ..... *E04H 17/185* (2021.01); *E04H 17/009* (2021.01); *E04H 17/1602* (2021.01)

(58) Field of Classification Search

CPC ... E04H 12/22; E04H 12/2276; E04H 17/009; E04H 17/14; E04H 17/16; E04H 17/1602; E04H 17/165; E04H 17/166; E04H 17/17; E04H 17/18; E04H 17/185; E04H 17/20; E04H 17/21; E04H 17/22; E04H 17/23; E01F 9/692; E04F 11/1812; E04F 11/1814; E04F 11/1846; F16B 9/02; F16B 9/05; F16B 9/058

USPC ..... 256/26

See application file for complete search history.

(56) References Cited

U.S. PATENT DOCUMENTS

| | | | |
|---|---|---|---|
| 1,044,214 | A | 11/1912 | Mast |
| 1,251,926 | A | 1/1918 | Schlesinger |
| 1,966,028 | A | 7/1934 | Dorris |
| 3,410,527 | A | 11/1968 | Uroshevich |
| 3,740,897 | A | 6/1973 | Johns |
| 3,800,110 | A | 3/1974 | Stephenson |

(Continued)

FOREIGN PATENT DOCUMENTS

| | | | | |
|---|---|---|---|---|
| DE | 202014002205 U1 | * | 7/2015 | ..... E04H 12/2238 |
| GB | 2412123 A | * | 9/2005 | ..... E04H 12/22 |
| WO | 2012000020 A1 | | 1/2012 | |

*Primary Examiner* — Josh Skroupa
*Assistant Examiner* — Kevin J Baynes
(74) *Attorney, Agent, or Firm* — Avek IP, LLC; Kent R. Erickson

(57) ABSTRACT

A temporary fencing assembly comprises a plurality of rectangular fence panels formed from fiberglass supported between fiberglass posts pivotally supported on a base formed from fiberglass. Each post includes two sets of vertically aligned hinge pins or hinge pin receivers projecting outward from opposite sides of the post. The fence panels are formed from rectangular, fiberglass tubing formed into a rectangular frame, each panel including a pair of side rails, a top rail and a bottom rail. The base includes a mounting stud welded to a mounting stud base. Two fiberglass T-posts are secured to the mounting stud base with legs of the T-posts extending under and covering a web of the mounting stud base.

8 Claims, 10 Drawing Sheets

(56) References Cited

U.S. PATENT DOCUMENTS 3,915,434 A * 10/1975 Lister ..... E04F 11/1812 248/188.7
4,492,364 A 1/1985 Boyanton
4,809,955 A 3/1989 Veilleux
4,923,165 A * 5/1990 Cockman ..... E04H 12/2223 52/157
5,123,623 A * 6/1992 McNamara ..... E04H 12/2215 248/156
5,901,526 A * 5/1999 Vidmar ..... E04H 12/2215 47/33
6,073,396 A * 6/2000 Kietzmann ..... E06B 11/04 16/237
6,178,694 B1 1/2001 Wagnitz
6,202,367 B1 * 3/2001 Marino ..... A01G 9/28 47/33
6,540,209 B2 * 4/2003 Ross ..... E04G 21/3233 256/73
6,588,732 B1 7/2003 Caceres et al.
6,802,106 B2 * 10/2004 Taglianetti ..... E05D 7/04 16/268
7,055,806 B2 * 6/2006 York, Jr. ..... E01F 13/022 256/28
7,121,529 B2 * 10/2006 Priefert ..... A01K 1/0005 256/65.01
7,278,240 B2 * 10/2007 Burkart ..... C08G 18/0823 52/165
7,322,564 B2 1/2008 Fakhari
7,338,033 B2 * 3/2008 Anson ..... E01F 9/692 256/65.01
7,677,000 B2 * 3/2010 Walker ..... E04F 11/1812 248/539
7,810,277 B2 10/2010 Fakhari
8,117,798 B2 * 2/2012 Bergman ..... E04H 12/2253 403/283
8,354,048 B2 1/2013 Caceres et al.
8,424,851 B2 * 4/2013 Christoffer ..... E01F 13/022 256/65.14
8,925,904 B2 1/2015 Christoffer et al.
8,931,670 B2 1/2015 Fakhari et al.
9,194,090 B2 * 11/2015 Raml ..... E01F 7/025
9,286,813 B2 3/2016 Fakhari et al.
9,458,645 B1 10/2016 King et al.
9,531,172 B1 12/2016 Fakhari
9,631,396 B2 4/2017 Leach
9,677,299 B2 * 6/2017 Whiteley ..... E01F 9/692
9,754,519 B2 9/2017 Fakhari et al.
9,926,679 B1 3/2018 Vila
2004/0140461 A1 7/2004 Lappen
2004/0144024 A1 7/2004 Caceres et al.
2005/0109998 A1 5/2005 Sadinsky
2005/0150158 A1 7/2005 Fakhari
2006/0202185 A1 9/2006 Fakhari
2006/0231821 A1 10/2006 Gavin
2008/0006808 A1 1/2008 Thompson
2008/0237560 A1 * 10/2008 Dehlsen ..... E04H 17/22 256/65.14
2009/0278105 A1 11/2009 McIlwain
2012/0192507 A1 * 8/2012 Paananen ..... E04H 12/2284 52/155
2012/0261632 A1 10/2012 Bertucat
2013/0105753 A1 5/2013 Cavanagh
2013/0248794 A1 9/2013 Callahan
2015/0259943 A1 * 9/2015 Paananen ..... E04H 12/2269 52/159
2016/0194895 A1 * 7/2016 Whiteley ..... E04H 12/22 248/346.5
2017/0096836 A1 4/2017 Ritter et al.
2017/0238474 A1 8/2017 Fakhari
2018/0007843 A1 1/2018 Fakhari
2018/0044867 A1 2/2018 Whiteley
2019/0234103 A1 8/2019 Fakhari

* cited by examiner 24
18
21
22
5
14
15
11
6
12
29
26
30
19
27

Fig.10.
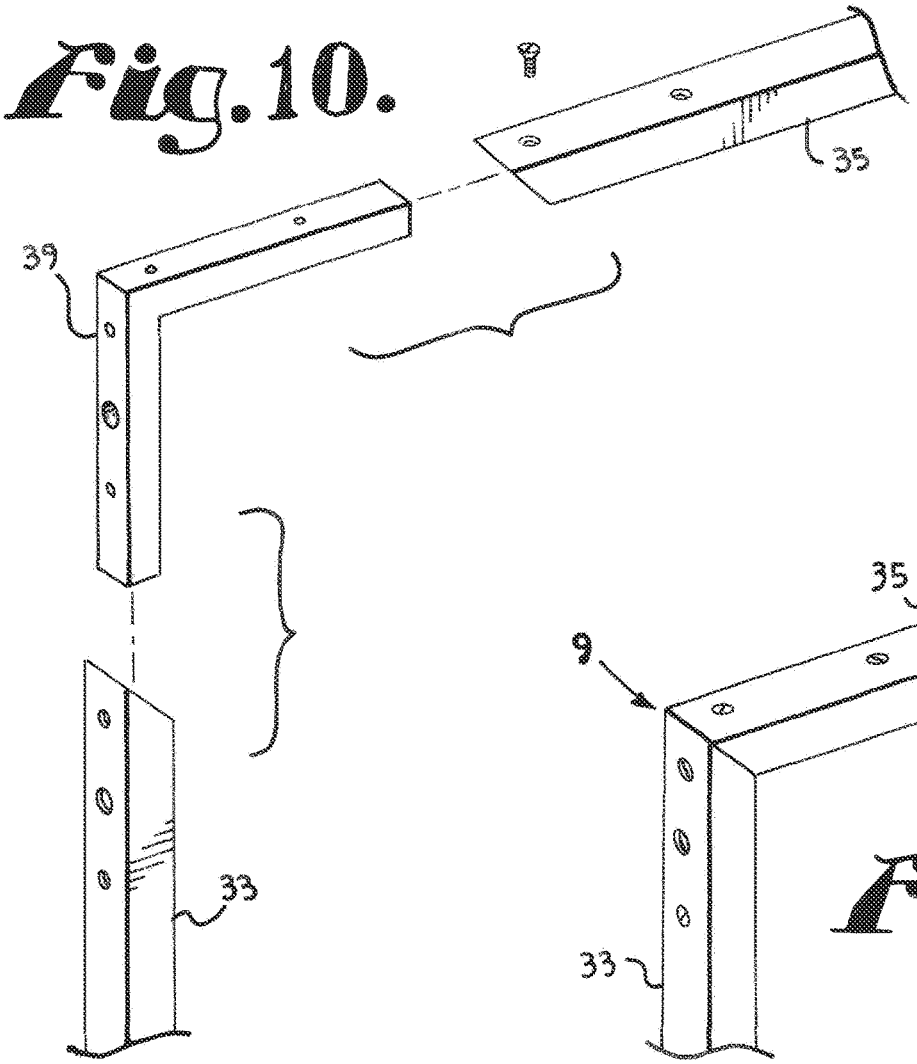
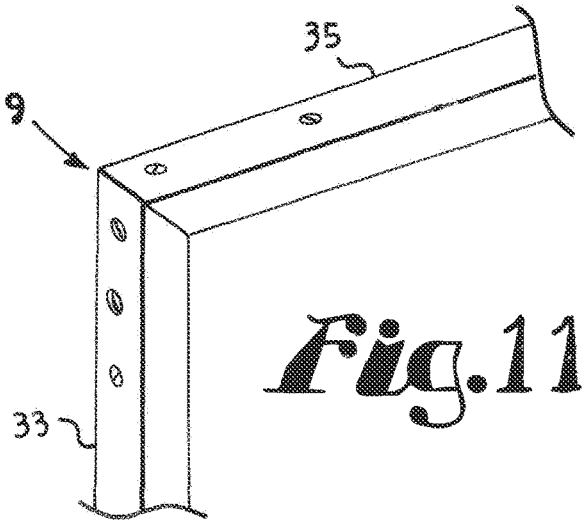
Fig.11.
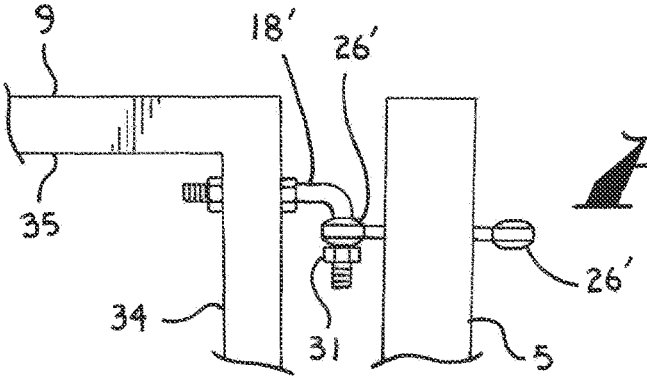
Fig.9.

TEMPORARY FENCE ASSEMBLY

CROSS-REFERENCE TO RELATED APPLICATIONS

This application is a continuation in part of U.S. patent application Ser. No. 16/261,124, filed Jan. 29, 2019 which claims the benefit of U.S. Provisional Patent Application No. 62/623,135, filed Jan. 29, 2018, the disclosures of which are hereby incorporated herein in their entirety by reference.

BACKGROUND OF THE INVENTION

Field of the Invention

This invention relates to temporary fencing assemblies for constructing temporary enclosures. More specifically, it relates to fencing components manufactured from electrically non-conductive composite material.

Background & Description of the Related Art

There is a need for relatively lightweight but sturdy temporary fencing systems to deter access to selected sites. In particular, there is a need for such fencing systems that are not electrically conductive. Currently available temporary security fencing might take the form of panels of chain link fencing with vertical posts on each end of a panel mountable on pins or rods extending upward from a base. Chain link fencing is relatively easy to scale, the chain link mesh is relatively easy to cut with wire cutters and the chain link panels are often easily lifted off of their bases to allow access to the site to be secured.

Electric utilities and electrical contractors have a need for non-conductive fencing options for securing areas in which they are performing work on electrical equipment or systems which is not satisfied by conventional chain link fencing or other fencing systems that are currently available. Plastic mesh, temporary fencing lacks sufficient strength or rigidity to adequately limit access to a site to be secured.

There remains a need for a temporary fencing assembly formed from durable and electrically non-conductive materials that is formed of relatively easy to assemble components.

SUMMARY OF THE INVENTION

The present invention is directed to a temporary fencing assembly formed from fiber reinforced, electrically non-conductive materials such as thermoset resins which may also be referred to as fiberglass. The temporary fencing assembly includes a plurality of identically constructed vertical support posts, each post having two hinge pins or hinge pin receivers projecting outward from opposite sides of the post. The post is rotatably mounted on a base with a round pin extending vertically upward and into a receiver on the lower end of an associated post such that the post pivots relative to the base about a vertical axis. A plurality of fence panels are formed from rectangular, fiberglass tubing formed into a rectangular frame, each panel including a pair of side rails, a top rail and a bottom rail. A plurality of relatively closely spaced vertical rods or pickets are attached to and extend from and between the top and bottom rail of each panel. Each of the pickets may also extend through a horizontal support rail extending medially between the top and bottom rails and laterally to provide additional rigidity to the assembly.

Each of the plurality of posts includes first upper and first lower hinge pins mounted on a first side of the post and second upper and second lower hinge pins mounted on a second side of the post opposite the first side. Each of the first upper and lower and second upper and lower hinge pins is supported in spaced relationship to the post and extends generally vertically. Upper and lower hinge pin receivers project outward from each of the first and second side rails. The upper and lower hinge pin receivers on the first side rail are pivotally securable on the first upper and lower hinge pins on the first side of a first one of the posts and the upper and lower hinge pin receivers on the second side rail are pivotally securable on the second upper and lower hinge pins on the second side of a second one of the posts such that each of the fence panels is supportable between two of the posts positioned in spaced relation on opposite sides of the fence panel with each of the posts capable of supporting ends of two of the fence panels on the first and second upper and lower hinge pins. A retainer, such as a nut is removably securable to each of the first and second upper and lower hinge pins for retaining a respective one of the upper and lower hinge pin receivers thereto.

The upper and lower rails and the first and second side rails and the pickets of each fence frame and each of the posts are formed from tubing formed from a fiber reinforced thermoset resin such as fiberglass. The base for each of the posts may be formed from tubing formed from a fiber reinforced thermoset resin such as fiberglass. An alternative embodiment of the base is formed from two fiberglass shoes secured to a metal, mounting stud base having a mounting stud projecting upward therefrom and over which a post is positioned. The fiberglass shoes cooperatively cover the bottom and sides of the mounting stud base and in one embodiment have a T-shaped cross-section and in another embodiment are L-shaped with inwardly extending legs extending across the bottom of the mounting stud base.

In an embodiment, at least one of fence panels comprises a gated panel having a gate opening bordered by a hinge jamb and a latch jamb extending in spaced relation between the top and bottom rails of the fence panel and a gate pivotally connected to the hinge jamb by at least one hinge connected between the gate and the hinge jamb. The gate is releasably securable to the latch jamb by a latch connected to the gate on a side opposite the at least one hinge. The gated panel comprises a gate frame formed from tubing formed from a fiber reinforced thermoset resin such as fiberglass.

BRIEF DESCRIPTION OF THE DRAWINGS

FIG. 9 is a view similar to FIG. 6 showing a hinge pin mounted on a side rail of the rectangular panel and hinge pin receivers mounted on a post.

FIG. 10 is a fragmentary and exploded perspective view of a corner of a frame forming the rectangular panel.

FIG. 11 is a fragmentary, perspective view of the corner of the frame.

DETAILED DESCRIPTION OF THE PREFERRED EMBODIMENTS

Figure 1:
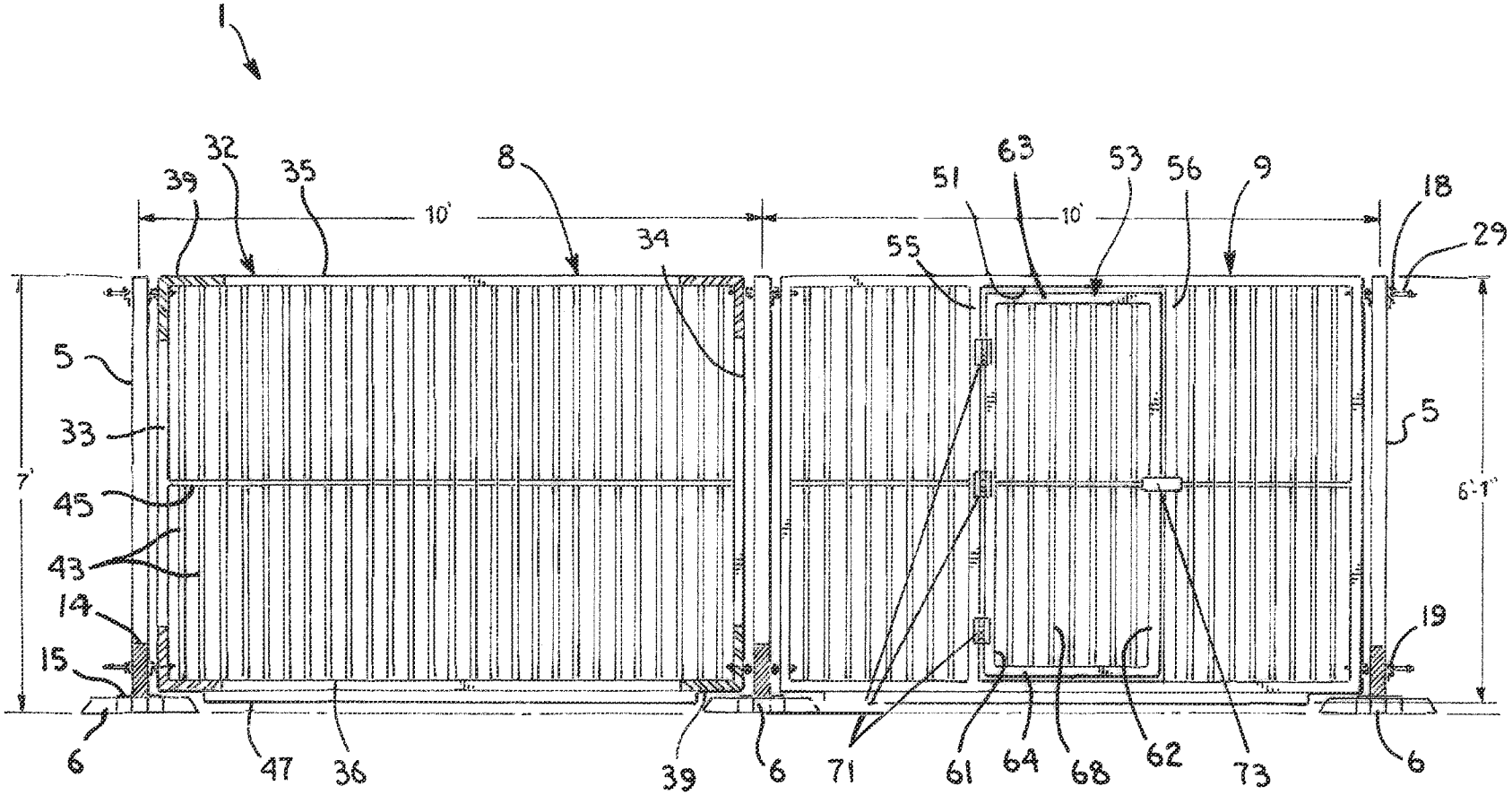
FIG. 1 is a front elevational view of a temporary fence assembly including a rectangular panel and a gated panel supported between posts supported on bases.
Figure 2:
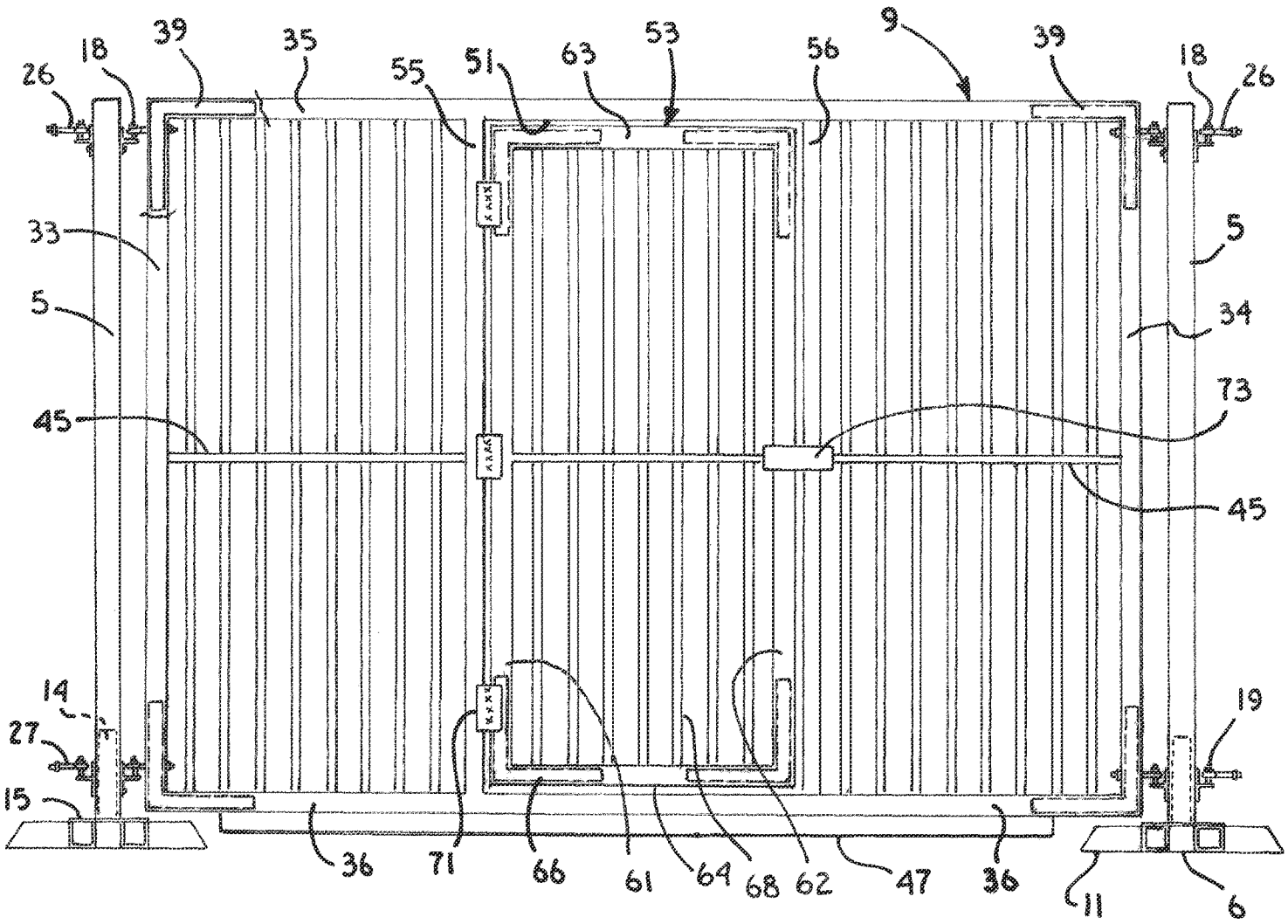
FIG. 2 is a front elevational view of a gated panel supported between posts supported on bases.
Figures 3, 4, 5:
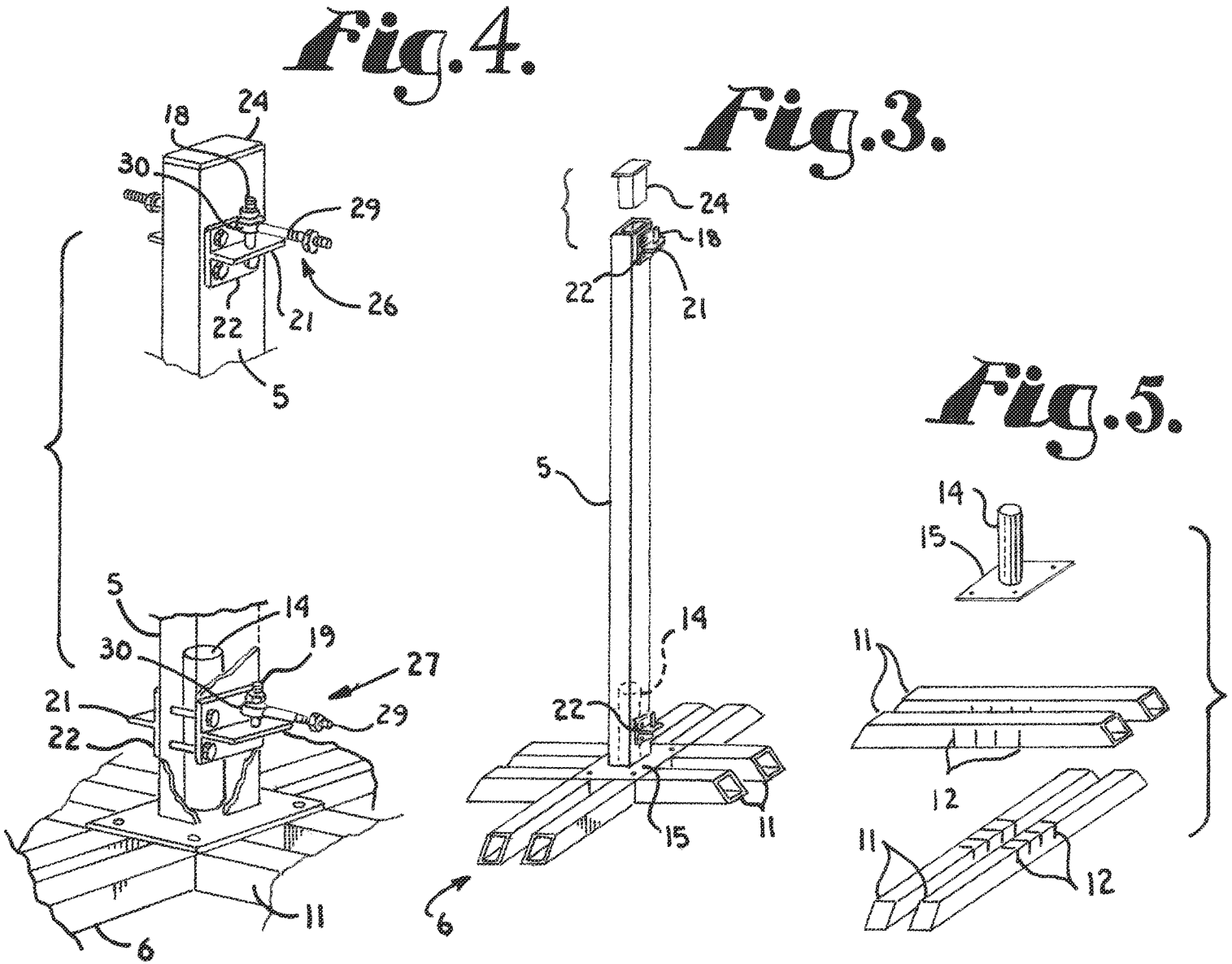
FIG. 3 is an exploded perspective view of a base and post of the temporary fence assembly.
FIG. 4 is an enlarged and fragmentary, perspective view of the post and base as in FIG. 3 with portions removed to show detail and including eye bolts for connecting the panels to hinge pins on the posts.
FIG. 5 is an enlarged and exploded perspective view of the base.
Figure 6:
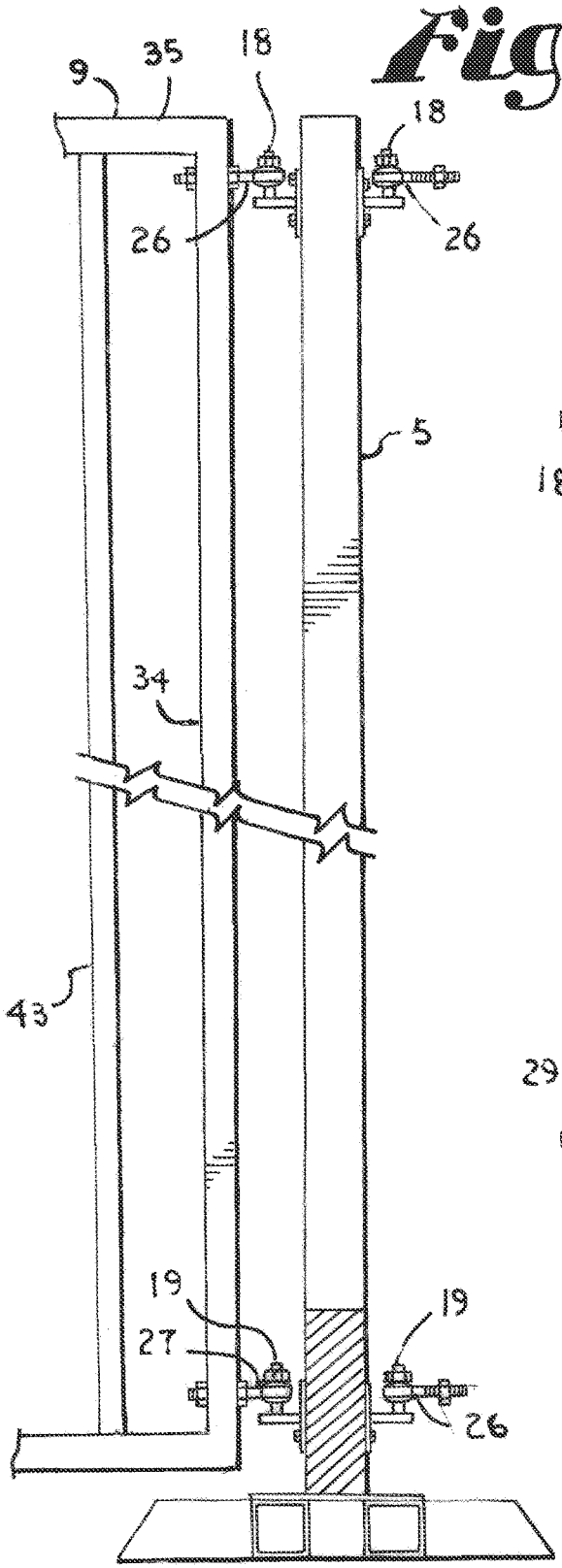
FIG. 6 is a greatly enlarged and fragmentary front elevational view of the temporary fence assembly as in FIG. 1 showing a portion of one end of the rectangular panel supported on one of the posts.
Figure 7:
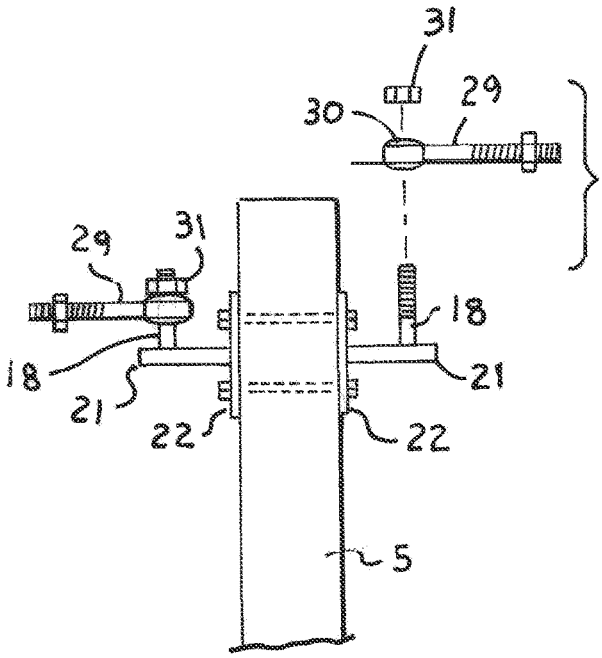
FIG. 7 is a greatly enlarged, fragmentary and exploded, front elevational view of one of the posts with the eyebolts for connecting the panels to the hinge pins on the posts.

Referring to the drawings in more detail, FIG. 1 shows an elevational view of two sections of a temporary fence assembly 1. Fence assembly 1 includes a plurality of vertical support posts 5, a corresponding number of bases 6, a plurality of standard rectangular panels 8, and preferably at least one, gated rectangular panel 9. The gated panel 9 is shown enlarged in FIG. 2. The posts 5 are supported on a respective base 6 and each panel 8 or 9 is hung from or supported between a pair of posts 5. The posts 5, bases 6 and panels 8 and 9 are preferably formed, at least in part, from non-electrically conductive material such as a fiber reinforced thermoset resin such as the material commonly referred to as fiberglass, so that a conductive path does not extend through the components of the fence assembly 1.

The posts 5 and bases 6, for the embodiment shown in FIG. 1, are shown in greater detail in FIGS. 3-8. Each base 6 is formed from overlapping and spaced apart pairs of short sections of fiberglass tubing 11 arranged to generally form a cross. Notches 12 are formed in one or both pairs of the short sections of tubing 11 to allow the tubing to overlap. In one embodiment, each section of tubing 11 forming one of the bases 6 may be square in cross-section, approximately three inches by three inches, with a length of approximately three feet.

A mounting pin 14 is connected to and projects upward from the short sections of tubing 11. A base plate 15 is connected to the lower end of the mounting pin 14 and the base plate 15 is then bolted to the short sections of tubing 11 forming the base 6. The mounting pin 14 and base plate 15 may be formed of metal but are electrically insulated from the ground by the tubing sections 11.

Each post 5 is formed from fiberglass tubing of a desired length or height, such as 6 feet and 9 inches in one example. The mounting pin 14 is dimensioned to allow a lower end of the hollow tubing forming post 5 to be slid over the mounting pin 14 to support the post 5 on the mounting pin 14 and base 6. The mounting pin 14 is preferably round in cross-section to allow the post 5 to rotate or pivot relative to the pin 14 and base 6.

Figure 8:
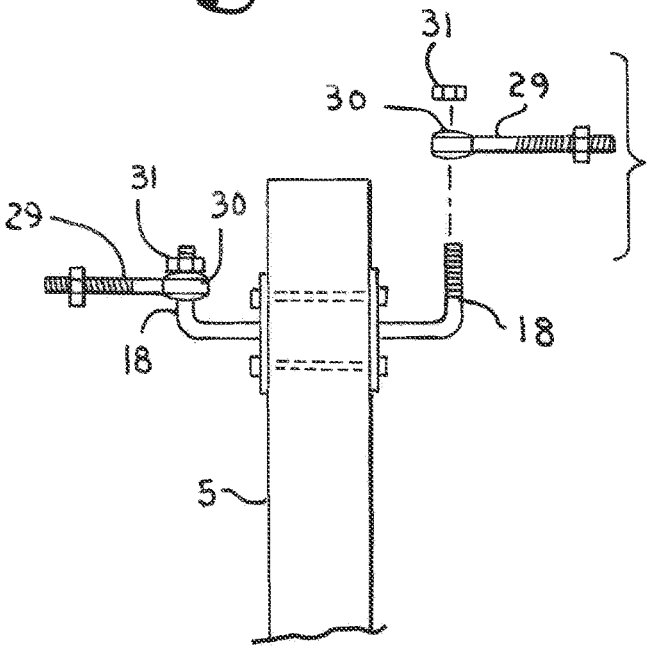
FIG. 8 is a view similar to FIG. 7 showing the hinge pins formed as hooks.
Figure 12:
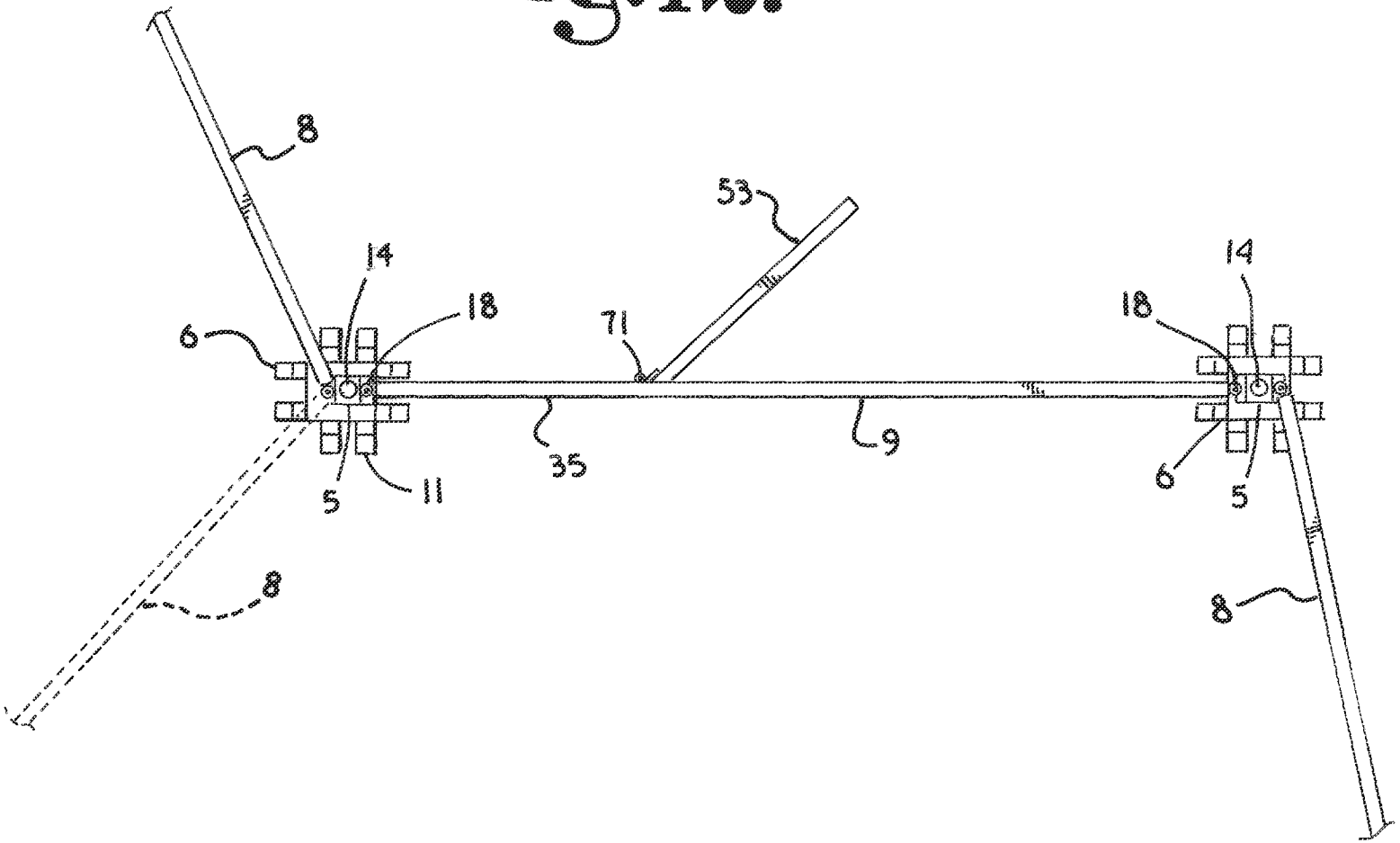
FIG. 12 is a fragmentary, top plan view of a plurality of panels supported on posts to form an enclosure with the panels oriented at different angles relative to each other.

Two sets of vertically aligned, upper and lower hinge pins 18 and 19 are mounted on and project outward from opposite, first and second sides of each post 5. Each hinge pin 18 and 19 is connected to and projects upward from a horizontal, outwardly projecting flange 21 of a mounting bracket 22 such that the hinge pins 18 and 19 extend vertically and in spaced relationship from the first and second sides of the post 5 respectively. Aligned pairs of mounting brackets 22 are bolted together on opposite sides of and through each post 5 at upper and lower positions. The bolts connecting the mounting brackets 22 proximate the lower end of each post 5 are spaced apart sufficiently to extend on opposite sides of the mounting pin 14. A cap 24 may be inserted into the upper end of each post 5. As shown in FIG. 8, it is also foreseen that each hinge pin (only upper hinge pins 18 are shown) could be formed generally as a hook projecting outward and then upward from a bracket mounted on the side of the post 5. In addition, as shown in FIG. 9, it is foreseen that the hinge pins, such as hinge pin 18' could be mounted on the sides of the frame 9 and the hinge pin receivers 26' on the posts 5. In such an application, the hinge pins preferably would be oriented to extend downward as shown to facilitate lifting the fence panels 8 and lowering them onto the posts 5 such that the hinge pins 18' are inserted downward into the hinge pin receivers 26' and then secured in place with a nut or other retainer 31.

Upper and lower hinge pin receivers 26 and 27 are connected to and project outward from the sides of the panels 8 and 9. In the embodiment shown, the hinge pin receivers 26 and 27 comprise eye bolts 28 with the eye 29 of each eye bolt 28 securable over and around an aligned hinge pin 18 or 19. Upper ends of each hinge pin 18 and 19 may be threaded such that a nut 31 may be threaded onto the threaded end over a respective hinge pin receiver 26 and 27 positioned on hinge pins 18 and 19. It is foreseen that retainers other than nuts 31 could be used to retain the hinge pin receivers 26 and 27 including for example, cotter pins or non-threaded caps secured on the end of the upper end of each hinge pin 18 and 19 by frictional engagement.

Rectangular panels 8 are formed from rectangular, fiberglass tubing formed into a rectangular frame 32 including a pair of side rails 33 and 34, a top rail 35 and a bottom rail 36. As best seen in FIGS. 9 and 10, L-shaped reinforcing members 39 are secured within the tubing forming the frame 32 at each corner with mitered ends of the side rails 33 and 34 and the top and bottom rails 35 and 36 extending over the legs of the L-shaped reinforcing members 39. The tubing forming the side rails 33 and 34 and top and bottom rails 35 and 36 may be connected to the L-shaped reinforcing members 39 by conventional means including fasteners, such as screws, driven through the rails 33-36 and the legs of the L-shaped reinforcing members 39 or using adhesives or the like. The eye bolts 28 are mounted to the side rails 33 and 34 through bores formed through the rails 33 and 34 and the vertical legs of the reinforcing members 39 with the eyes 29 projecting outward.

A plurality of relatively closely spaced vertical rods or pickets 43 are attached to and extend from and between the top and bottom rail 35 and 36 of each panel 8. Bores (not shown) may be formed in the inner surface of the top and bottom rails 35 and 36 to receive the ends of the pickets 43. It is foreseen that for ease of assembly, bores could be formed completely through either or both of the top and bottom rails 35 or 36 with the pickets 43, inserted through the bores then secured in place with screws driven through the sides of the rails 35 and 36 and into the ends of the pickets 43. A horizontal support rail 45 is shown in FIG. 1 extending medially between the top and bottom rails 35 and 36 and laterally between the side rails 33 and 34 to provide additional rigidity to the assembly. The pickets 43 extend through aligned bores formed in the horizontal support rail 45.

A toe plate or footer 47 is secured to the bottom of the bottom rail 36. The footer 47 may be formed from a section of fiberglass tubing that is cut shorter than the bottom rail 36 with the footer 47 centered along the bottom rail 36. The footer 47 reduces the gap between the bottom of the panel 8 and the ground between the bases 6 when the panel 8 is hung between two posts 5. The footer 47 is shorter than the bottom rail 36 to provide clearance for each base 6.

Gated panels 9 are constructed similarly to panels 8 but include an opening 51 for a gate or door 53 with the gate or door 53 hung on the panel 9. The opening 51 is bordered by jambs 55 and 56 which are formed from fiberglass tubing connected to and extending between the top and bottom rails 35 and 36 in spaced apart relation.

The gate 53 includes or is formed from a hinge stile 61, latch stile 62, top rail 63 and bottom rail 64. The stiles 61 and 62 and rails 63 and 64 are preferably formed from mitered sections of fiberglass tubing connected together over L-shaped reinforcing members 66 in each corner of the gate 53. Pickets 68 are connected to and extend between the top and bottom rails 63 and 64 of the gate 53 in closely spaced relation. The pickets 68 also extend through a horizontal support rail 69 extending laterally between the hinge stile 61 and latch stile 62 and medially between the top and bottom rails 63 and 64.

The gate 53 is hung from the hinge jamb 55 on hinges 71, three of which are shown in the embodiment of FIG. 1. Each hinge 71 is connected between the hinge jamb 55 bordering the opening 51 and the hinge stile 61 of the gate 53. A latch or first latch member 73 is mounted on the latch stile 62 and a latch receiver or second latch member 74 (not shown) is mounted on the latch jamb 56. The latch 73 releasably engages the latch receiver 74 to secure the gate 53 closed relative to the gated panel 9 and across the gate opening 51. It is foreseen that the latch 73 may be designed to cooperatively engage the latch jamb 56 without the need for a separate latch receiver. Structure may be included on the first and second latch members 73 and 74 or elsewhere on the gate 53 and gate panel 9 for locking the gate 53 closed. Alternatively, cables or chains may be secured around and locked in place around the latch stile 62 and latch jamb 56 for locking the gate 53 closed.

In one example of the fence assembly 1, the panels 8 and 9 are sized so that they can be supported on posts 5 spaced ten feet apart. In assembling an enclosure using the components of the fence assembly 1, two bases 6 are spaced ten feet apart and the posts are set over the mounting pins 14. The posts 5 are rotated relative to their respective base 6 until opposed sets of upper and lower hinge pins 18 and 19 are aligned between the posts 5. A panel 8 or 9 is then lifted into place and hung from the spaced apart posts 5 with the eyes 30 of eye bolts 29 set over the two sets of upper and lower hinge pins 18 and 19. Nuts 31 are then threaded onto the upper ends of the hinge pins 18 and 19 over the eye 30 of the associated eye bolt 29 to secure the panel 8 or 9 to the hinge pins 18 and 19 and the posts 5.

Additional posts 5 are then positioned at a spacing of ten feet from the first set of posts 5 and panels 8 or 9 are hung between the posts 5 to form an enclosure. As shown in FIG. 11, the pivotal connection formed between the hinge pins 18 and 19 on the posts 5 and the eye bolts 29 projecting from the sides of the panels 8 and 9, allow selective angular orientation of adjacent panels 8 or 9 to form enclosures of infinite shapes to accommodate the shape of the items to be enclosed.

Figure 13:
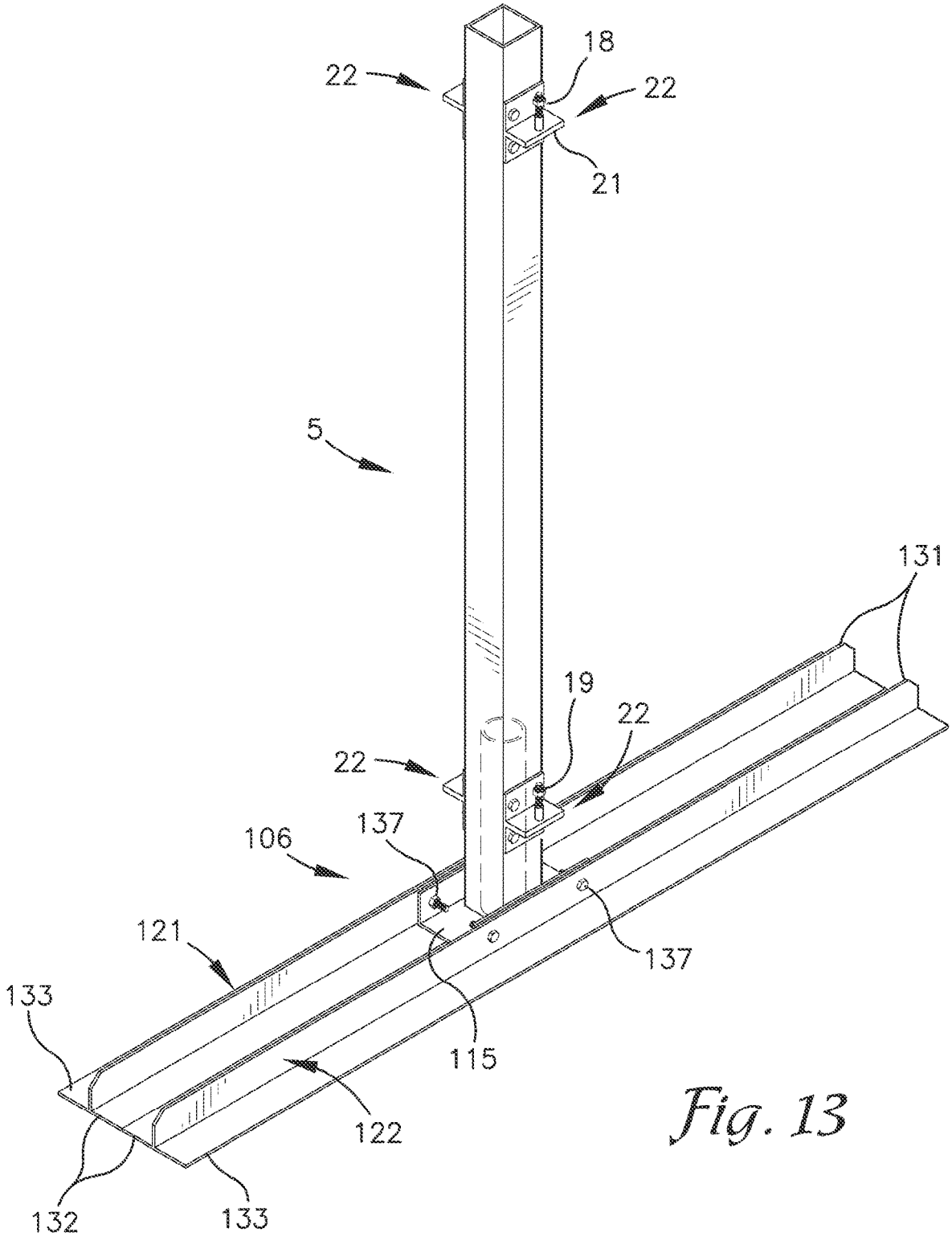
FIG. 13 is a perspective view of an alternative base supporting a post of the temporary fence assembly.

FIG. 13 is a perspective view showing a modified support post base 106 supporting vertical support post 5 of temporary fence assembly 1. The support post base 106 includes a mounting pin or mounting stud 114 connected at a lower end to a mounting stud base 115 to which two insulated feet 121 and 122 are secured. In the embodiment shown, the mounting stud base 115 and mounting stud 114 are formed from metal such a steel and the mounting stud 114, which comprises a cylindrical tube, is welded to the mounting stud base 114. The insulated feet 121 and 122 are preferably formed, at least in part, from a non-electrically conductive material such as a fiber reinforced thermoset resin such as the material commonly referred to as fiberglass, so that a conductive path does not extend through the components of the fence assembly 1.

Figure 14:
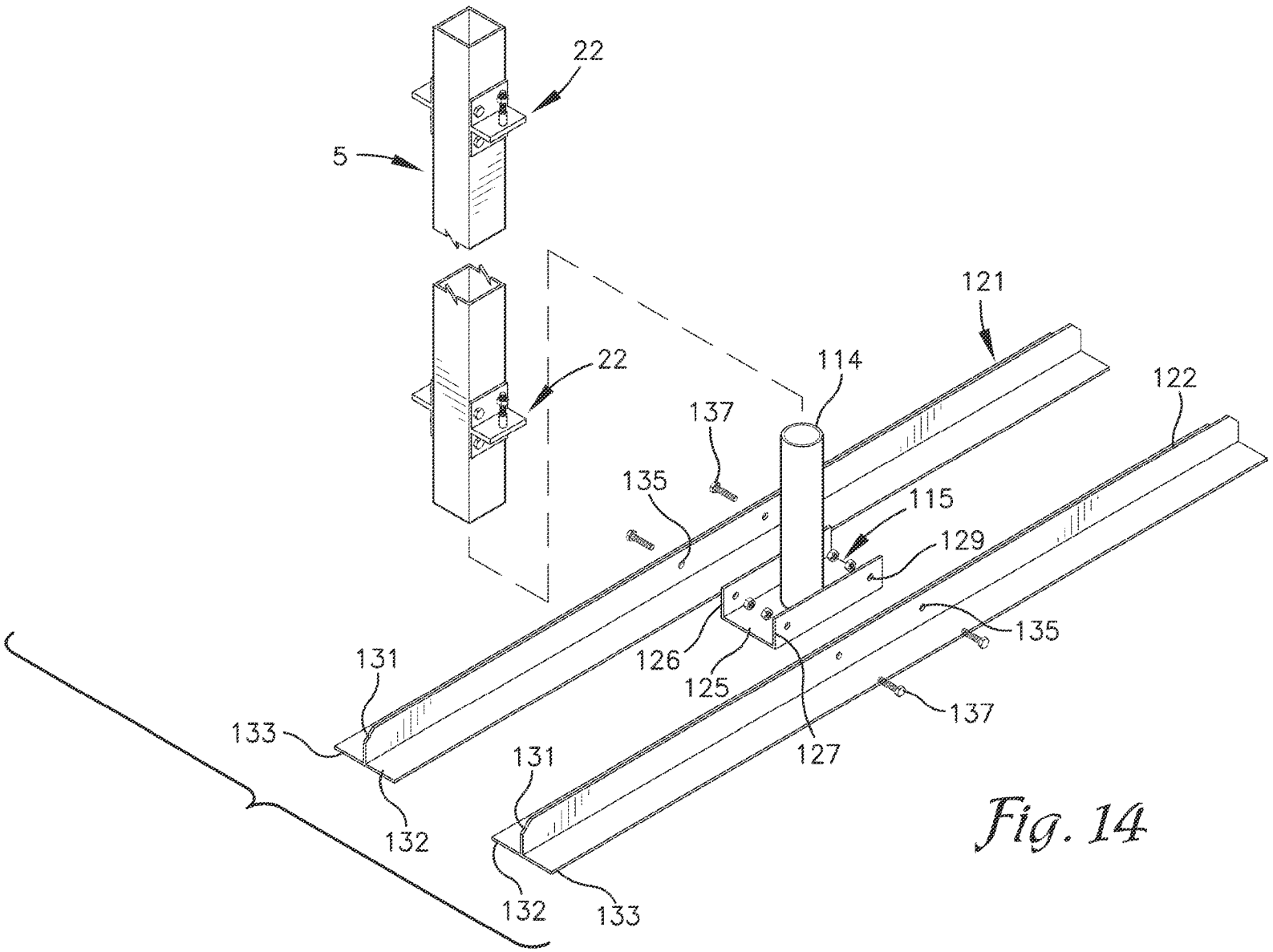
FIG. 14 is a fragmentary and exploded perspective view of the alternative base and post as shown in FIG. 13 showing a mounting stud base and two T-shaped feet forming the alternative base.

In the embodiment shown in FIGS. 13 and 14, the mounting stud base 114 is formed as a rectangular U-shaped channel with a floor or web 125 which is longer than it is wide and with first and second upstanding sidewalls or mounting flanges 126 and 127 extending perpendicular to and across outer edges of the web 125. At least one, and in the embodiment shown, two fastener receiving holes 129 are formed in each of the first and second mounting flanges 126 and 127. The mounting stud 114 is dimensioned to allow a lower end of the hollow tube forming post 5 to be slid over the mounting stud 114 to support the post 5 on the mounting stud 114 and base 106. The first and second mounting flanges 126 and 127 of the mounting stud base 115 are spaced wider apart than the diameter or width of the mounting stud 114 such that a gap is formed between the mounting stud 114 and each mounting flange 126 and 127. The gap is sized to receive a sidewall of the post 5.

The web 125 and the first and second mounting flanges 126 and 127 are preferably formed longer than the width of the post 5. The fastener receiving holes 129 one each mounting flange 126 and 127 are spaced apart wider than the width of the post 5 and in equal spacing from a center line extending through the mounting stud 114 so that the fastener receiving holes 129 are spaced outward on the first and second mounting flanges 126 and 127 past the post 5 mounted on the mounting stud 114.

In the preferred embodiment, each of the first and second insulating feet 121 and 122 are formed with a T-shape cross section including a central stem 131 and first and second flanges 132 and 133 projecting perpendicular to the central stem on opposite sides of an end thereof. First and second flanges 132 and 133 may also be referred to as inner and outer flanges or first and second legs or inner and outer legs 132 and 133. The width of each leg 132 and 133, from the stem 131 is preferably one half the width of the web 125 of mounting stud base 115. For example, in one embodiment the legs 132 and 133 are each approximately two and one half inches wide and the web 125 of the mounting stud base 115 is approximately five inches wide. Two fastener receiving holes 135 are formed in the central stem 131 of each insulating foot 121 and 122, generally medially relative to the length of the foot 121 and 122 and in a spacing corresponding to the spacing of the fastener receiving holes 129 in the first and second mounting flanges 126 and 127 of mounting stud base 115.

The stem 131 of each insulated foot 121 and 122 is fastened to one of the first and second mounting flanges 126 and 127 by inserting fasteners 137 through aligned sets of fastener receiving holes 129 and 136 in the mounting flanges 126 and 127 of the mounting stud base 115 and the central stem 131 of the respective foot 121 and 122. The inwardly extending legs 132 of the feet 121 and 122 extend under the mounting stud base 115 and are sized so that the outer ends of each of the inwardly extending legs 132 abut and the inwardly extending legs cover the entire bottom of the mounting stud base 115 to provide an insulating layer between the mounting stud base 115 and the ground. The outwardly extending flanges 133 provide additional surface area to provide greater lateral support for the vertical support post 5.

In an embodiment, the length of each T-shaped foot 121 and 122 is approximately 36 inches, the stem 131 is one quarter inch wide and the inner and outer legs 132 and 133 are two and one half inches wide. When two T-shaped feet 121 and 122 are secured to the mounting stud base 115 and extend adjacent to each other in abutting relationship the total width of the two feet 121 and 122 is approximately 10½ inches. The stem 131 of each foot 121 and 122 preferably has a height or length equal to the height of each of the first and second mounting flanges 126 and 127 of the mounting stud base 115. The stem 131 is typically shorter than or equal in length to the width of each inner and outer leg 132 and 133 of the feet 121 and 122. In the example described herein, the stem 131 may range 1-2.5 inches in height. The mounting stud base 115 in the example described is approximately 9 inches long or one quarter the length of each foot 121 and 122. In the example described, the vertical support post 5 may be formed from three inch by three inch square tubing with the mounting stud 114 sized to be received in the hollow interior of the vertical support post 5.

Two sets of vertically aligned, upper and lower hinge pins 18 and 19 are mounted on and project outward from opposite, first and second sides of each post 5. Each hinge pin 18 and 19 is connected to and projects upward from a horizontal, outwardly projecting flange 21 of a mounting bracket 22 such that the hinge pins 18 and 19 extend vertically and in spaced relationship from the first and second sides of the post 5 respectively.

Figure 16:
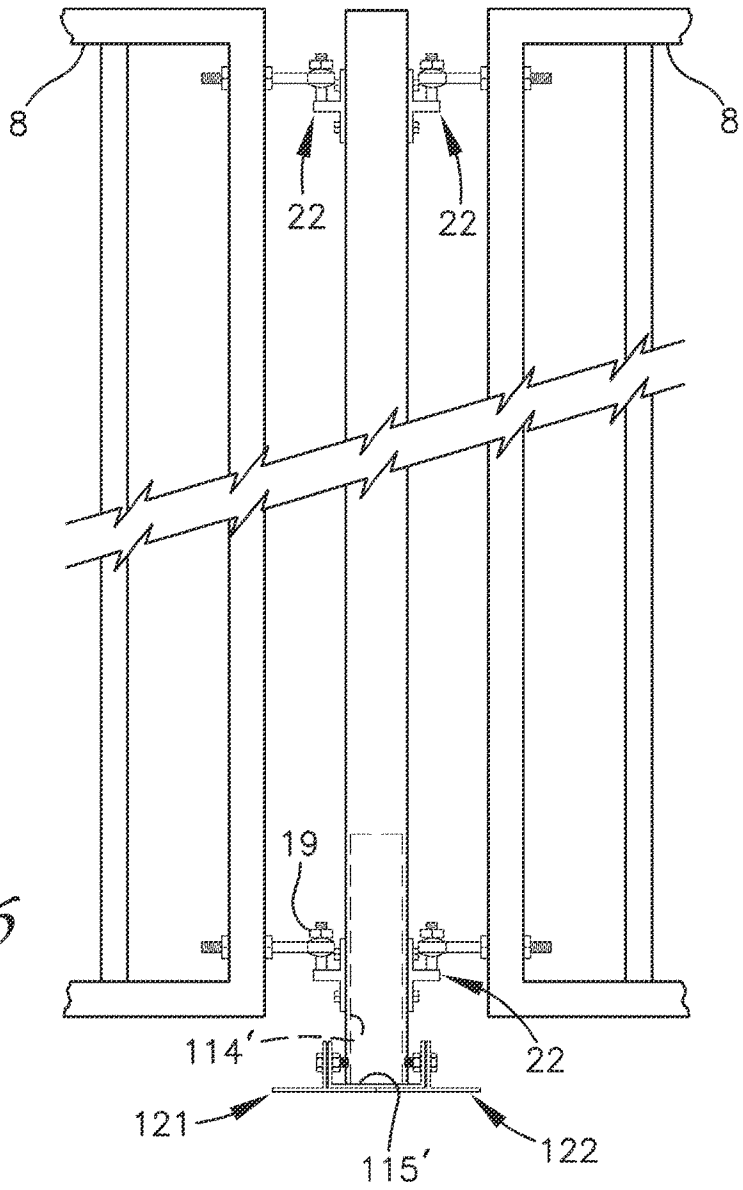
FIG. 16 is a fragmentary elevational view of the temporary fence assembly including the alternative base of FIG. 13 with the alternative mounting stud base of FIG. 15.
Figure 15:
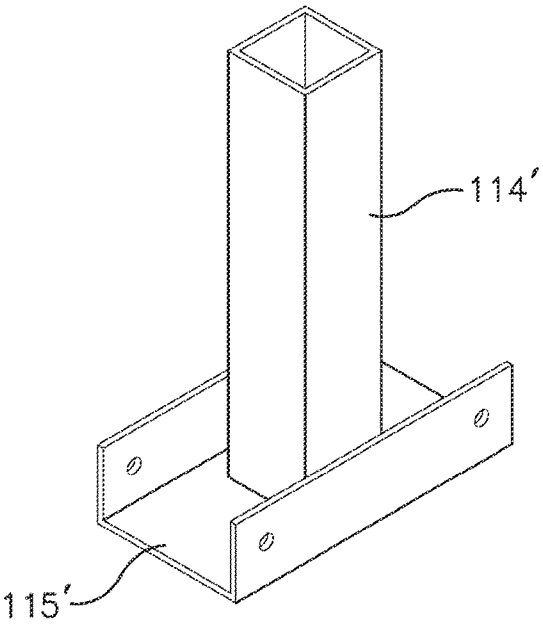
FIG. 15 is a perspective view of an alternative mounting stud base.

FIG. 15 shows an alternative embodiment of a mounting stud base 115' in which the mounting stud 114' has a square cross-section sized to be received within the hollow interior of the square tube forming post 5. It is foreseen that the inner dimensions of the mounting stud 114' could be sized wider than the outer dimensions of the tubing forming the post 5 such that the lower end of post 5 could be received in tubular mounting stud 114'. The mounting stud 114' is secured to the web 125 generally centrally thereto. FIG. 16 shows two fiberglass feet 121 and 122 secured to the modified mounting stud base 115' with vertical support post 5 supported on mounting stud 114' and two rectangular fence panels 8 hingedly connected to the vertical support post 5.

Figure 17:
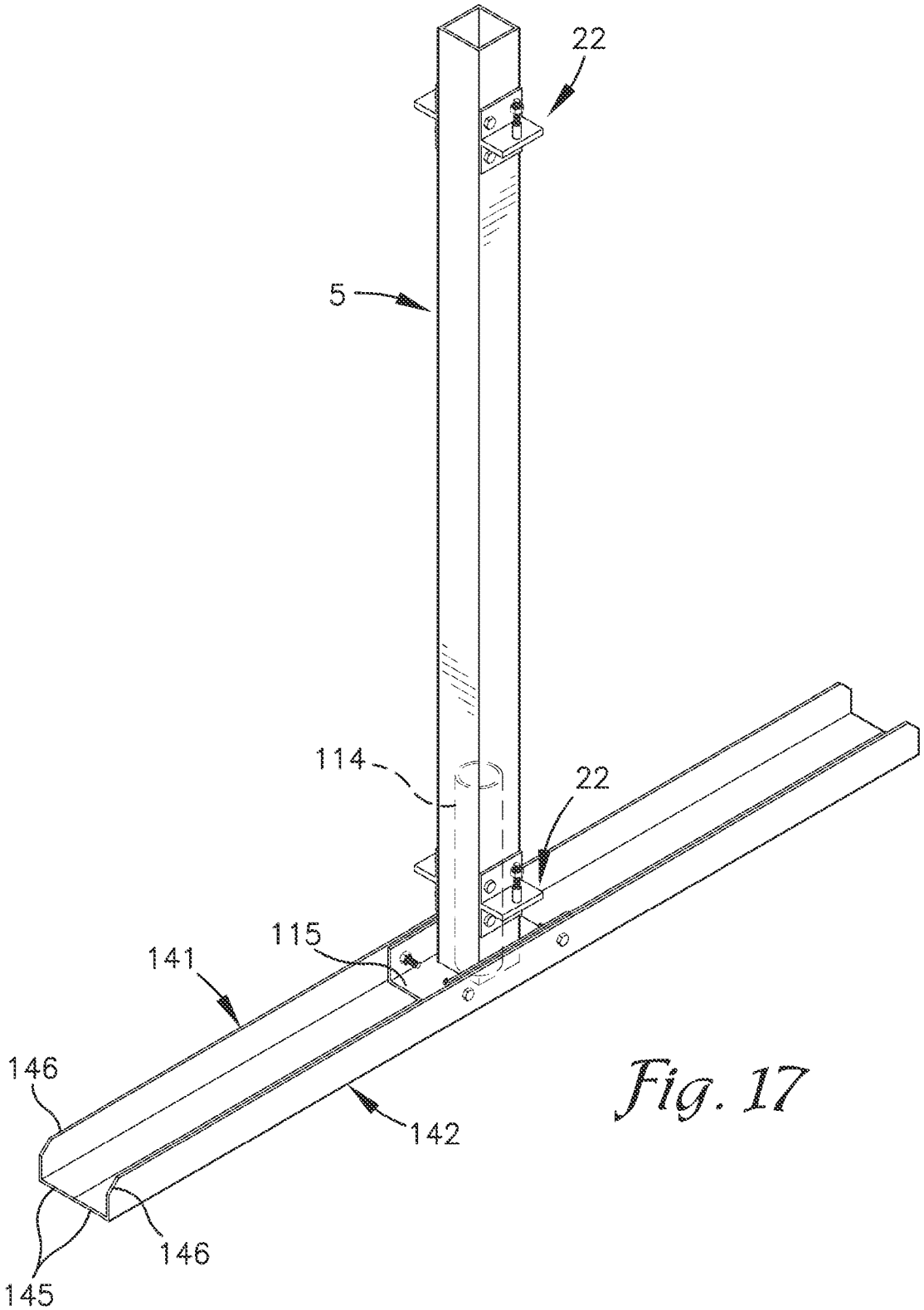
FIG. 17 is a perspective view of a further alternative base supporting a post of the temporary fence assembly.

In a further alternative embodiment as shown in FIG. 17, first and second feet 141 and 142 are L-shaped with a horizontal leg 145 and a vertical stem 146 and having fastener receiving holes formed in the vertical stem 146 in a spacing corresponding to the spacing of fastener receiving holes 129 in the mounting flanges 126 and 127 of the mounting stud base 115. In FIG. 17, fasteners 137 are shown positioned in the fastener receiving holes in the vertical stems 146 such that the fastener receiving holes 129 are not shown. The horizontal leg 145 of each foot 141 and 142 is preferably half as wide as the web 125 of mounting stud base 115 such that when the first and second feet 141 and 142 are secured to the mounting stud base 115, the horizontal legs 145 of the feet 141 and 142 extend under and cover the web 125.

The fiber reinforced components may be formed using a variety of manufacturing methods including a pultrusion process. Pultrusion involves pulling reinforcing fibers or matting through a vat of resin and then through a heated die where the resin undergoes polymerization encasing the fibers and forming the desired, uniform shape of the component.

It is to be understood that while certain forms of the present invention have been illustrated and described herein, it is not to be limited to the specific forms or arrangement of parts described and shown.

What is claimed is:

1. A temporary fence assembly comprising:

a plurality of posts, each post formed from a fiber reinforced thermoset resin, each post removably securable to a fence post support base; each of said posts having at least one first hinge member on first and second sides of said post;

a plurality of fence panels, each said fence panel comprising a frame including upper and lower rails and first and second said rails; each of the upper and lower rails and each of the first and second side rails formed from a fiber reinforced thermoset resin, each of said first and second side rails having at least one second hinge member thereon, the at least one second hinge member each of said first and second side rails pivotally connectable to one of the first hinge members on one of said posts;

a plurality of fence post support bases, each fence post support base including a mounting stud secured to a mounting stud base, the mounting stud receivable within a lower end of a respective one of the plurality of posts, the mounting stud base including a web to which the mounting stud is centrally secured and first and second mounting flanges extending perpendicular to the web on opposite sides thereon in spaced relation from the mounting stud, each fence post support base further comprising first and second elongate feet formed from a fiber reinforced thermoset resin, each of the first and second elongate feet having a stem secured to a respective one of the first and second mounting flanges of the mounting stud base and a leg extending under the web of the mounting stud base, wherein the leg has a width that is approximately half the width of the web such that ends of the legs of the first and second elongate feet abut and the legs cover an outer surface of the web of the mounting stud base.

2. The temporary fencing assembly as in claim 1 wherein said mounting stud and said mounting stud base are formed from metal.

3. The temporary fencing assembly as in claim 1 wherein said first hinge member comprises a hinge pin and said second hinge member comprises a hinge pin receiver.

4. The temporary fence assembly as in claim 1 where the vertical height of the stem of each foot is approximately equal to the vertical height of the mounting flange of the mounting stud base to which the stem is secured.

5. A temporary fence assembly comprising:

a plurality of posts, each post formed from a fiber reinforced thermoset resin, each post removably securable to a fence post support base; each of said posts having at least one first hinge member on first and second sides of said post;

a plurality of fence panels, each said fence panel comprising a frame including upper and lower rails and first and second said rails; each of the upper and lower rails and each of the first and second side rails formed from a fiber reinforced thermoset resin, each of said first and second side rails having at least one second hinge member thereon, the at least one second hinge member each of said first and second side rails pivotally connectable to one of the first hinge members on one of said posts;

a plurality of fence post support bases, each fence post support base including a mounting stud secured to a mounting stud base, the mounting stud receivable within a lower end of a respective one of the plurality of posts, the mounting stud base including a web to which the mounting stud is centrally secured and first and second mounting flanges extending perpendicular to the web on opposite sides thereon in spaced relation from the mounting stud, each fence post support base further comprising first and second elongate feet formed from a fiber reinforced thermoset resin, each of the first and second elongate feet having a stem secured to a respective one of the first and second mounting flanges of the mounting stud base, a first leg extending under the web of the mounting stud base and a second leg extending outward from the stem and opposite the first leg, wherein the first leg has a width that is approximately half the width of the web such that ends of the first legs of the first and second elongate feet abut and the first legs cover an outer surface of the web of the mounting stud base.

6. The temporary fencing assembly as in claim 5 wherein said mounting stud and said mounting stud base are formed from metal.

7. The temporary fencing assembly as in claim 5 wherein said first hinge member comprises a hinge pin and said second hinge member comprises a hinge pin receiver.

8. The temporary fence assembly as in claim 5 where the vertical height of the stem of each foot is approximately equal to the vertical height of the mounting flange of the mounting stud base to which the stem is secured.

* * * * *